US005542806A

United States Patent [19]

Kang

[11] Patent Number: 5,542,806

[45] Date of Patent: Aug. 6, 1996

[54] FLUID ACTUATED LIFTING AND TILTING DEVICE

[75] Inventor: Lei Kang, Fairfield, Ohio

[73] Assignee: The Champion Company, Springfield, Ohio

[21] Appl. No.: 414,197

[22] Filed: Mar. 31, 1995

[51] Int. Cl.[6] ..... B66F 3/35

[52] U.S. Cl. ..... 414/422; 187/273; 254/93 HP; 414/678

[58] Field of Search ..... 414/422, 425, 414/458, 471, 628, 639, 640, 678, 778; 187/269, 273; 254/3 R, 3 C, 93 HP; 298/1 A, 11, 22 R

[56] References Cited

U.S. PATENT DOCUMENTS

| | | | |
|---|---|---|---|
| 2,503,180 | 4/1950 | Wagner . | |
| 2,610,824 | 3/1948 | Grier . | |
| 3,174,722 | 9/1962 | Alm . | |
| 3,623,617 | 11/1971 | Nemesanyi . | |
| 3,784,255 | 1/1974 | Smock | 298/22 R X |
| 4,572,579 | 2/1986 | Saito | 298/22 R X |
| 4,786,032 | 11/1988 | Garman et al. | 254/93 HP |
| 5,160,237 | 11/1992 | Lutz | 414/639 X |
| 5,299,906 | 4/1994 | Stone . | |
| 5,419,534 | 5/1995 | Vesely | 254/93 HPX |

FOREIGN PATENT DOCUMENTS

| | | | |
|---|---|---|---|
| 1473991 | 1/1966 | France . | |
| 38 01 491 | 8/1989 | Germany | 254/3 C |
| 625079 | 9/1978 | U.S.S.R. . | |
| 2023231 | 12/1979 | United Kingdom | 254/93 HP |
| 2024167 | 1/1980 | United Kingdom | 254/93 HP |

*Primary Examiner*—James W. Keenan

*Attorney, Agent, or Firm*—Fay, Sharpe, Beall, Fagan, Minnich & McKee

[57] ABSTRACT

The lifting and tilting device includes fluid actuated bellows type of lifting motors which lift and tilt a container with respect to a base. The lifting motors are supported by pairs of scissor mechanisms which pivot with respect to one another when the lifting motors expand and contract. The scissor mechanisms are partially slidable with respect to the base and the container to permit raising and lowering of the container. The container is designed to receive material at a certain level and then dispense of the material at the same or different level. The fluid preferably used is air.

7 Claims, 4 Drawing Sheets

FLUID ACTUATED LIFTING AND TILTING DEVICE

BACKGROUND OF THE INVENTION

This invention relates to a device for both lifting and tilting heavy objects in an industrial environment. However, the device finds application in any environment where an object needs to be delivered from a first elevation to a second elevation with the option of tilting the object to a desired orientation.

Fluid operated lifting jacks have been proposed in the art. Specifically U.S. Pat. Nos. 2,610,824; 3,174,722; 5,299,906 and French 1,473,991 all disclose lifting devices which are fluid actuated. Furthermore, U.S. Pat. No. 2,503,180 discloses a mobile lift apparatus which employs a plurality of lazy tong arms 106 and tiltable lift arms. Likewise, U.S. Pat. No. 3,623,617 discloses a cargo handling device which includes cross scissor legs which operate in conjunction with the tilt adjusting system 12. Lastly, Soviet Patent 625,079 discloses a resilient lifting jack configuration.

SUMMARY OF THE INVENTION

The present invention relates to a pneumatically powered device having a first side and a second side for use in lifting and tilting objects. The device includes a first lifting means on the first side of the device, wherein the first lifting means has an upper portion, a lower portion, and an intermediate extent therebetween. Likewise, a second lifting means is included on the second side of the device, wherein the second lifting means includes an upper portion, a lower portion, and an intermediate extent therebetween. A series of bellows-type lifting motors are operatively secured to each of the lifting means. Each of the bellows-type lifting motors functions to selectively raise and lower a first and second lifting means. The device also includes a container having an open top, a closed bottom, an open forward portion and a closed rearward portion. The rearward portion of the container is pivotally secured to both the upper portion of the first lifting means and the upper portion of the second lifting means. A bellows-type pivoting motor which is operatively secured to the container and to the upper portion of the first lifting means and the upper portion of the second lifting means functions to pivot the container relative to both the first and second lifting means.

Thus, it is an object of the present invention to provide a pneumatically powered lifting and tilting device for use in lifting heavy objects.

Furthermore, it is an object of the present invention to provide such a device which employs arcuate-shaped lifting and tilting motors.

It is yet another object of the present invention to provide a device which can selectively raise heavy objects to one of any number of desired elevations, with the capability of floor level loading the object without the use of a forklift or the like.

Likewise, it is an object of the present invention to provide a device which can tilt a heavy object to any one of a number of desired inclinations.

These and other objects of the present invention will become apparent in view of the following description.

BRIEF DESCRIPTION OF THE DRAWINGS

The invention is diagrammatically illustrated by way of example in the accompanying drawings in which.

DETAILED DESCRIPTION OF THE PREFERRED EMBODIMENT

Figure 1:
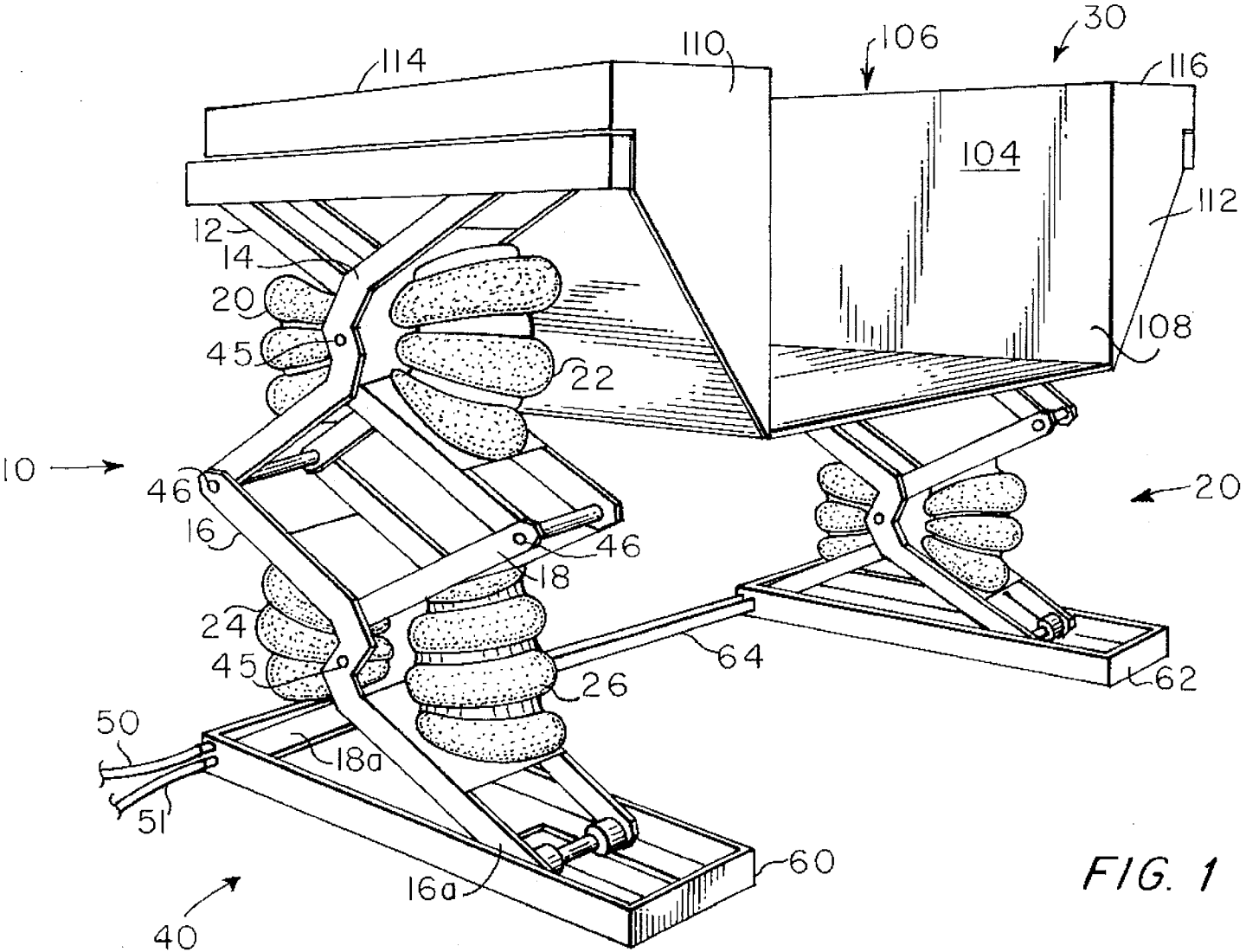
FIG. 1 is a perspective view of the lifting and tilting device in accordance with an embodiment of the present invention.

The present invention will now be disclosed in terms of its preferred embodiment. FIG. 1 illustrates a perspective view of the lifting and tilting device in its raised position. As shown in the Figure, the device includes a base 40 onto which lifting means 10 is mounted. A container 30 is mounted onto lifting means 10. Lifting means 10 is provided on one side of container 30, while an identical lifting means 20 is provided on another side of the container 30. For the purposes of this description, only lifting means 10 will be described in detail. It is to be understood that lifting means 20 is arranged in a manner similar to lifting means 10 and functions in a similar way.

Figure 4:
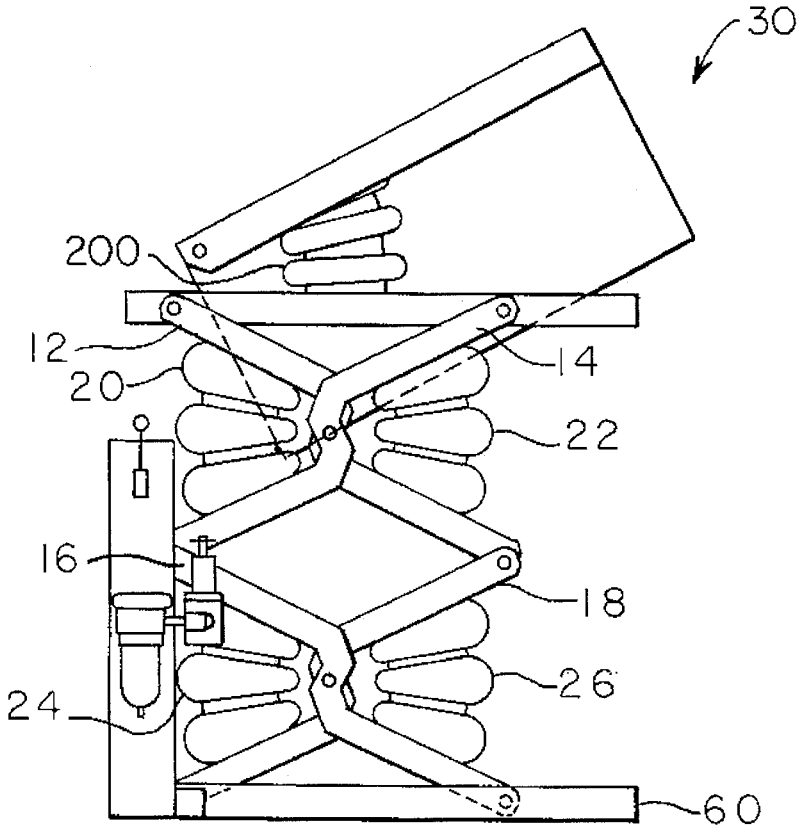
FIG. 4 is a side elevational view of the device in an expanded and pivoted state.
Figure 6:
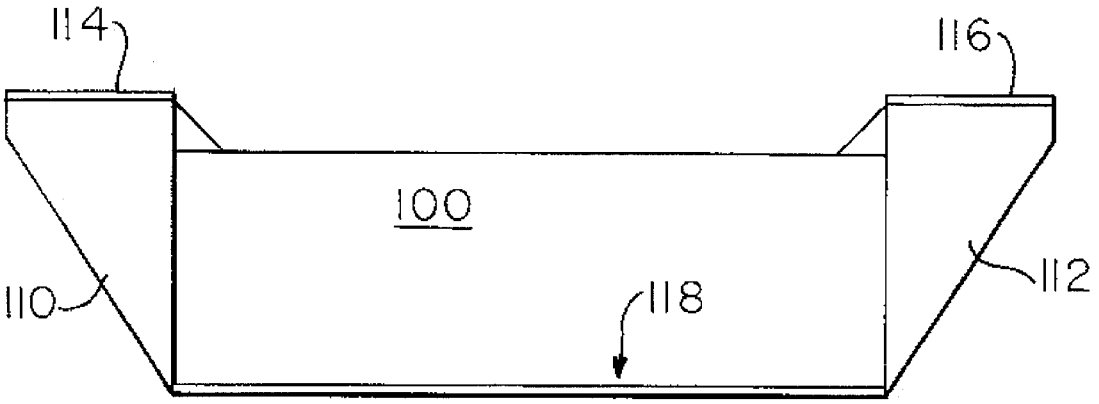
FIG. 6 is a front view of the container for use in conjunction with the device.
Figure 7:
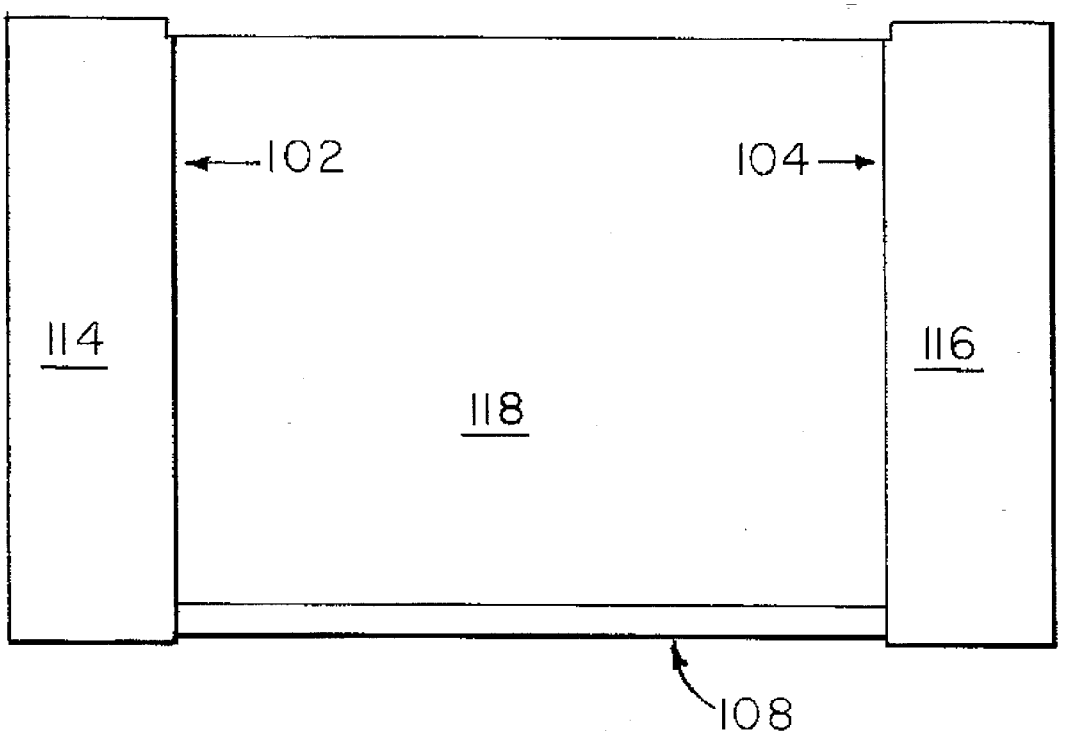
FIG. 7 is a top view of the container for use in conjunction with the device according to the present invention.

The container 30 preferably employed according to the present invention is further illustrated by a front view in FIG. 6 and a top view in FIG. 7. As illustrated in these figures, the container preferably has a closed bottom, a closed rearward portion, or a rear wall 100, and two side walls 102 and 104. The top and forward portions are preferably open in order to transfer material into and out of the container 30. The top of the container is generally designated by 106, while the forward portion of the container is generally designated by 108. While these embodiments disclosed illustrate top and forward portions that are completely open (106 and 108), it is to be understood that one of ordinary skill in the art may be able to vary this design in minor ways and still perform the same functions. Side walls 102 and 104 are provided with generally triangular shaped pieces 110 and 112, respectively. Triangular pieces 110 and 112 are inverted with respect to base 40. Extending from the top of and perpendicular to side walls 102 and 104 are rectangular sections 114 and 116. These rectangular sections 114 and 116 generally lie in a plane that is parallel with the base 118 of container 30. Means are provided under rectangular sections 114 and 116 so as to permit lifting means 10 and 20 to be attached in a manner that permits pivoting motor 200, and another motor (not shown) on the other side of the device from motor 200, to be properly positioned. Pivoting motor 200 is shown in FIG. 4. These two pivoting motors, also referred to as first and second pivoting motors, are each formed from an arcuate bellows and are positioned between the container and the upper portion of the first and second lifting means respectively. Together, the pivoting motors serve to pivot the container relative to the lifting means.

Lifting means 10, as shown in FIG. 1 includes an upper and lower set of scissor mechanisms and a plurality of arcuate, bellows type lifting motors. Each set of scissor mechanisms includes an upper portion, a lower portion and an intermediate extent therebetween. Furthermore, each set of scissor mechanisms has an outside pair which is connected to an inside pair, where the phrase inside pair is intended to refer to that scissor mechanism which is closest to the inside of the container 30. For the purpose of this description, only the outside pair of the scissor mechanisms will be described. It is to be understood that the inside pair of scissor mechanisms is structurally equivalent to the outside pair and functions in the same manner. In fact, pairs of scissor mechanisms are provided for structural stability.

As shown in FIG. 1, an upper scissor mechanism is formed by substantially, S-shaped members 12 and 14. These members, 12 and 14, are generally in the shape of an S, except that they are defined by two legs that are provided with an intermediate extent, or offset portion, therebetween which is generally perpendicular to the two legs. S-shaped member 12 has its intermediate extent coupled with the intermediate extent of S-shaped member 14 by a pin 45.

A lower scissor mechanism is formed in a manner similar to the upper scissor mechanism and includes S-shaped members 16 and 18 which are coupled by another pin 45. Furthermore, the lower portion of the upper scissor mechanism is pivotally coupled to the upper portion of the lower scissor mechanism by a pair of pins 46. Pins 45 and 46 as discussed herein are used to provide a pivoting relationship between structural elements. Lifting motors 20 and 22 are operatively secured on the upper pair of scissor mechanisms while lifting motors 24 and 26 are operatively secured on the lower pair of scissor mechanisms.

The rearward portion 18*a* of S-shaped member 18 is fixed to base 40 while the forward portion 16*a* of S-shaped member 16 is slidably mounted within base 40. Similarly, the rearward portion (not shown) of S-shaped member 12 is fixed while the forward portion (not shown) of S-shaped member 14 is slidably mounted with respect to container 30. The same is true for the corresponding components of the inner members of the set. The slidable mounting of the legs can be accomplished by employing rollers, for example.

Thus, the pivotal relationship of scissor mechanisms is capable of moving when lifting motors 20, 22, 24 and 26 are pressurized with a fluid from a first fluid circuit 50. This first fluid circuit provides communication between all the bellows type lifting motors and a source of fluid under pressure. As shown in FIG. 1, a second fluid circuit 51 is used to supply fluid to pivoting motor 200, which is shown in FIG. 4. Providing fluid to the second circuit causes the container to be pivoted relative to the scissor mechanisms.

The base 40, as shown in FIG. 1, includes a pair of rectangular supports 60 and 62 connected by a rear portion 64. Rectangular portion 60 supports lifting means 10 while rectangular portion 62 supports lifting means 20. Rectangular portions 60 and 62 specifically contribute to permit forward portion of an S-shaped member (such as 16*a*) to slide therein. Rear portion 64 contains a torque rod (not shown) to balance the torque from one side of the device to the other. This is particularly useful when pneumatic devices are used. This torque rod is preferably a heavy wall tube.

Figure 2:
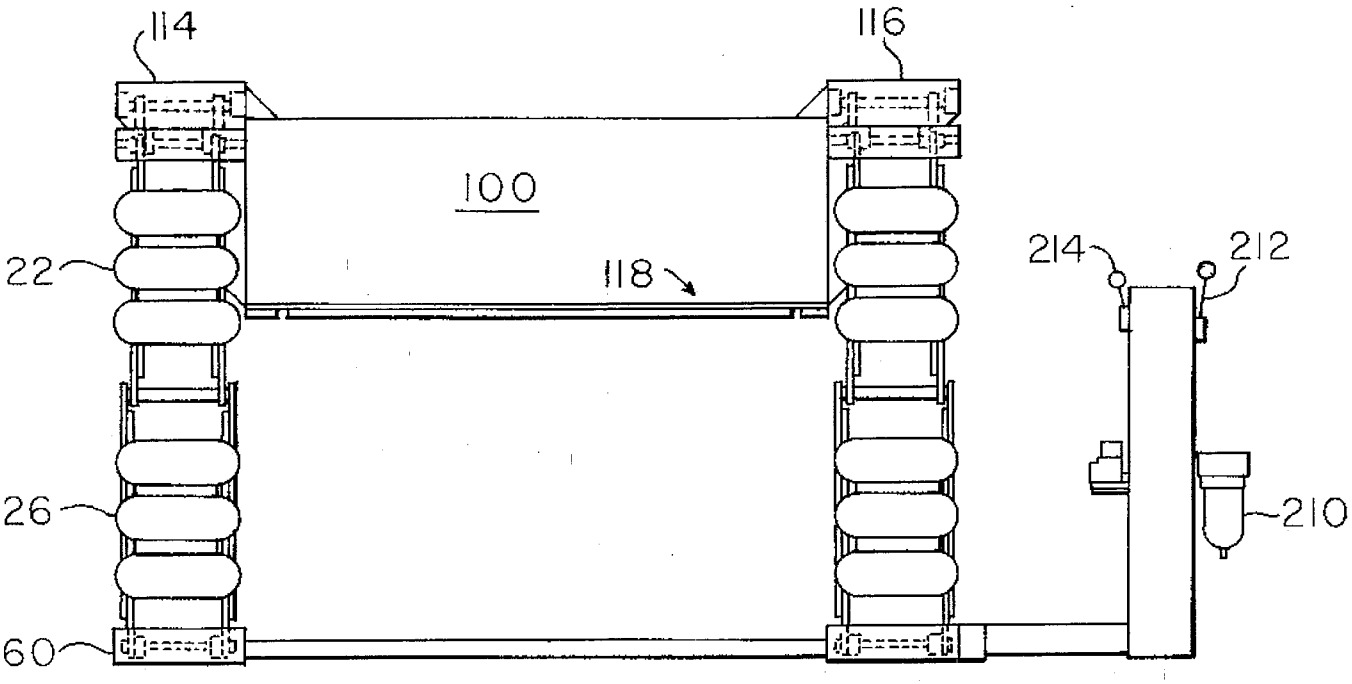
FIG. 2 is a front elevational view of the lifting and tilting device in accordance with the present invention.

FIG. 2 illustrates a front view of the lifting and tilting device according to a preferred embodiment of the present invention. Identical numerals are used to identify identical elements throughout the figures. FIG. 2 illustrates a fluid circuit motor 210 and first and second fluid circuit controls 212 and 214, respectively. Controls 212 and 214 are used to lift and tilt, respectively, container 30. Motor 210 and controls 212 and 214 are shown near the right side of the device in the Figure by way of example only.

Figure 3:
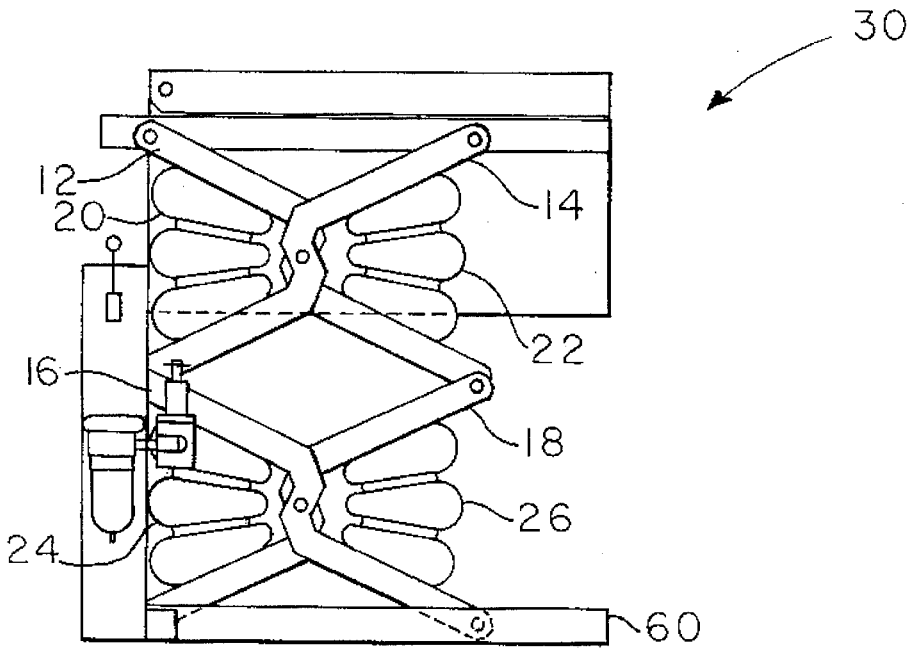
FIG. 3 is a side elevational view of the device in an expanded but unpivoted state.

In FIGS. 3 and 4, motor 210 and controls 212 and 214 are provided near the left side of the device, when viewed from the front. FIG. 3 illustrates a side view of a lifting and tilting device with the container 30 being in a raised condition but not tilted. FIG. 4 illustrates a side view of the device with the container 30 in a tilted position.

Figure 5:
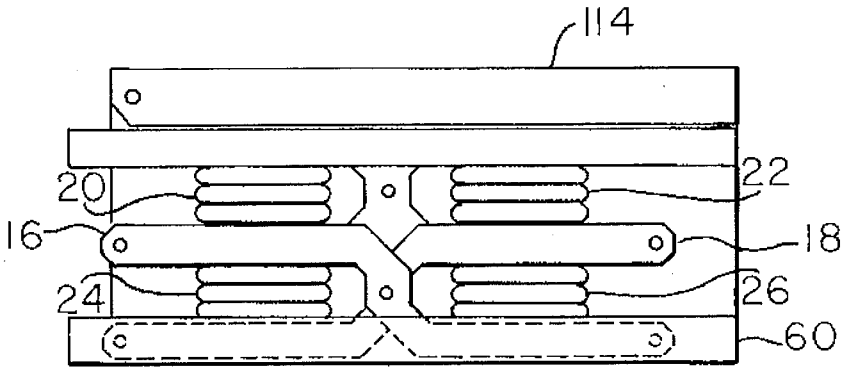
FIG. 5 is a side view of the device according to the present invention in a compressed state capable of floor level loading.

FIG. 5 illustrates a side view of a lifting and tilting device according to the present invention in its compressed state. Motor 210 and controls 212 and 214 are not shown in this Figure. When in its compressed state, the device is capable of being loaded without the use of a fork lift. In other words, a push cart or pallet jack can be employed. In this regard, it is important that the lifting and tilting device according to the present invention be capable of lifting a load from a floor level. The floor level is substantially at the same level as base 40.

In operation, an operator using the control means can selectively deliver fluid power to either of the fluid circuits. When power is delivered to the first fluid circuit, each of the bellows type lifting motors expands and all of the scissor mechanisms are raised. When an operator wishes to pivot the container, fluid power is delivered to the second fluid circuit which expands both of the bellows type pivoting motors and thus pivots the container relative to the remainder of the device. When the power is removed from the first and second fluid circuits, the container is slowly leveled with respect to the remainder of the device and the lifting assemblies slowly take their collapsed configuration.

Therefore, material can be received by the container at a number of different levels and transported to a number of different levels, before being dispensed out of the container by tilting, if necessary. Specifically, an object may be loaded into the container at a floor, or base, level and raised to a higher level before being tilted out of the container.

Although the present invention has been described with particular reference to the preferred embodiments, one of ordinary skill in the art would be enabled by this disclosure to make various modifications to the preferred embodiments and still be within the scope and spirit of the present invention as defined in the appended claims.

What is claimed is:

1. A pneumatically powered device having a first side and a second side for use in lifting and tilting objects comprising in combination:

a first lifting means on the first side of the device, the first lifting means having an upper portion, a lower portion, and an intermediate extent therebetween;

a second lifting means on the second side of the device, the second lifting means having an upper portion, a lower portion, and an intermediate extent therebetween;

a series of bellows-type lifting motors operatively secured to each of the lifting means, said series of bellows-type lifting motors functioning to selectively raise and lower the first and second lifting means;

a container having a forward portion and a rearward portion, the container being mounted on the first and second lifting means;

a bellows-type pivoting motor operatively secured to the container and to the upper portion of the first lifting means, the bellows-type pivoting motor functioning to pivot the container relative to the first lifting means;

wherein said first lifting means on the first side of the device comprises an upper set of scissor mechanisms on the first side of the device, said upper set of scissor mechanisms on the first side of the device having an upper portion and a lower portion and an intermediate extent therebetween;

a lower set of scissor mechanisms on the first side of the device, said lower set of scissor mechanisms having an upper portion and a lower portion and an intermediate extent therebetween, said lower portion of said upper set of scissor mechanisms being pivotally secured to said upper portion of said lower set of scissor mechanisms;

wherein said second lifting means comprises an upper set of scissor mechanisms on the second side of the device, said upper set of scissor mechanisms having an upper portion and a lower portion and an intermediate extent therebetween; and a lower set of scissor mechanisms on the second side of the device, said lower set of scissor mechanisms having an upper portion and a lower portion and an intermediate extent therebetween, said lower portion of said upper set of scissor mechanisms being pivotally secured to said upper portion of said lower set of scissor mechanisms;

a fluid circuit providing fluid communication between all of the bellows type lifting motors, the fluid circuit functioning such that when pressurized fluid is delivered therein the bellows type lifting motors expand and raise the container;

a second fluid circuit in communication with the bellows type pivoting motors, the second fluid circuit functioning such that when pressurized fluid is delivered therein the container is pivoted relative to the scissor mechanisms;

wherein each of said scissor mechanisms comprises in combination a first linkage having a first leg and a second leg and a substantially perpendicular intermediate portion therebetween; and a second linkage having a first leg and a second leg and a substantially perpendicular intermediate portion therebetween, wherein said substantially perpendicular intermediate portion of said first linkage is pivotally connected to said substantially perpendicular intermediate portion of said second linkage.

2. The device as claimed in claim 1 further comprising:

a base onto which the first and second lifting means are mounted, the base being located at a floor level and said first and second lifting means capable of lowering the container to approximately the floor level;

wherein said lower portion of said lower set of scissor mechanisms on the first side of the device includes a forward portion and a rearward portion;

said lower portion of said lower set of scissor mechanisms on the second side of the device includes a forward portion and a rearward portion;

said rearward portion of said scissor mechanisms on the first side of the device is fixedly secured to the base, and said forward portion of said scissor mechanisms on the first side of the device is slidably coupled to the base; and said rearward portion of said scissor mechanisms on the second of the device is fixedly secured to the base and said forward portion of said scissor mechanism on the second side of the device is slidably coupled to the base.

3. The device according to claim 2, wherein the container includes an open top and closed bottom, and wherein said forward portion of the container is open and said rearward portion of the container is closed, and wherein said rearward portion of said container is pivotally secured to both the upper portion of the first lifting means and the upper portion of the second lifting means.

4. A pneumatically powered device having a first side and a second side for use in lifting and tilting objects comprising in combination:

an upper set of scissor mechanisms on the first side of the device, said upper set of scissor mechanisms having an upper portion and a lower portion and an intermediate extent therebetween;

a lower set of scissor mechanisms on the first side of the device, said lower set of scissor mechanisms having an upper portion and a lower portion and an intermediate extent therebetween, said lower portion of said upper set of scissor mechanisms being pivotally secured to said upper portion of said lower set of scissor mechanisms;

an upper set of scissor mechanisms on the second side of the device, said upper set of scissor mechanisms having an upper portion and a lower portion and an intermediate extent therebetween;

a lower set of scissor mechanisms on the second side of the device, said lower set of scissor mechanisms having an upper portion and a lower portion and an intermediate extent therebetween, said lower portion of said upper set of scissor mechanisms being pivotally secured to said upper portion of said lower set of scissor mechanisms;

a series of bellows type lifting motors operatively secured to all of said scissor mechanisms, said series of bellows type lifting motors functioning to selectively raise and lower said scissor mechanisms in unison;

a container having a forward portion and a rearward portion, the rearward portion of the container being pivotally secured to the upper portions of the upper set of scissor mechanisms, said rearward portion of said container being pivotally secured to said upper portion of said upper set of scissor mechanisms on the first side of the device and to said upper portion of said upper set of scissor mechanisms on the second side of the device;

a base coupled to the lower set of scissor mechanisms on the first and second side of the device; and a first bellows type pivoting motor operatively secured to said container and to said upper portion of said upper set of scissor mechanisms on the first side of the device, a second bellows type pivoting motor operatively secured to said container and to said upper portion of said upper set of scissor mechanism on the second side of the device, said first and second bellows type pivoting motors functioning to pivot the container relative to the base.

5. A pneumatically powered device for use in lifting and tilting objects comprising in combination:

a first side outer lifting assembly including an upper scissor linkage having an upper end and a lower end and an intermediate extent therebetween, and a lower scissor linkage having an upper end and a lower end and an intermediate extent therebetween, wherein said lower end of said upper scissor linkage is pivotally secured to said upper end of said lower scissor linkage;

a first side inner lifting assembly including an upper scissor linkage having an upper end and a lower end and an intermediate extent therebetween, and a lower scissor linkage having an upper end and a lower end and an intermediate extent therebetween, wherein said lower end of said upper scissor linkage is pivotally secured to said upper end of said lower scissor linkage;

a second side outer lifting assembly including an upper scissor linkage having an upper end and a lower end and an intermediate extent therebetween, and a lower scissor linkage having an upper end and a lower end and an intermediate extent therebetween, wherein said lower end of said upper scissor linkage is pivotally secured to said upper end of said lower scissor linkage;

a second side inner lifting assembly including an upper scissor linkage having an upper end and a lower end and an intermediate extent therebetween, and a lower scissor linkage having an upper end and a lower end and an intermediate extent therebetween, wherein said lower end of said upper scissor linkage is pivotally secured to said upper end of said lower scissor linkage;

a series of bellows type lifting motors operatively connected to the scissor linkages;

a container having a forward portion and a rearward portion, the rearward portion of the container being pivotally secured to each lifting assembly;

a base coupled to each lifting assembly; and a bellows type pivoting motor, said bellows type pivoting motor functioning to pivot said container relative to the base.

6. The device according to claim 5, wherein the base is located at a first level, and wherein the lifting assemblies are capable of lowering the container to a level approximately equal to the first level so as to permit easy loading of material into the container.

7. A pneumatically powered device having a first side and a second side for use in lifting and tilting objects comprising in combination:

an upper set of scissor mechanisms on the first side of the device, the upper set of scissor mechanisms having an upper portion and a lower portion and an offset pivot therebetween;

a lower set of scissor mechanisms on the first side of the device, the lower set of scissor mechanisms having an upper portion and a lower portion and an offset pivot therebetween, the lower portion of the upper set of scissor mechanisms being pivotally secured to the upper portion of the lower set of scissor mechanisms;

an upper set of scissor mechanisms on the second side of the device, the upper set of scissor mechanisms having an upper portion and a lower portion and an offset pivot therebetween;

a lower set of scissor mechanisms on the second side of the device, the lower set of scissor mechanisms having an upper portion and a lower portion and an offset pivot therebetween, the lower portion of the upper set of scissor mechanisms being pivotally secured to the upper portion of the lower set of scissor mechanisms;

a plurality of bellows type lifting motors operatively secured in-between all of the scissor mechanisms;

a container having a forward portion and a rearward portion, the rearward portion of the container being pivotally secured to the upper portions of the upper set of scissor mechanisms;

a bellows type pivoting motor operatively secured to both the container and the upper portions of the upper set of scissor mechanisms, the bellows type pivoting motor functioning to pivot the container relative to the scissor mechanisms.

* * * * *